US011289800B2

(12) United States Patent
Udagave

(10) Patent No.: US 11,289,800 B2
(45) Date of Patent: Mar. 29, 2022

(54) REMOTE ELECTRONIC TILT BASE STATION ANTENNAS HAVING ADJUSTABLE RET ROD SUPPORTS

(71) Applicant: CommScope Technologies LLC, Hickory, NC (US)

(72) Inventor: Shital Sawanta Udagave, Maharashtra (IN)

(73) Assignee: CommScope Technologies LLC, Hickory, NC (US)

( * ) Notice: Subject to any disclaimer, the term of this patent is extended or adjusted under 35 U.S.C. 154(b) by 47 days.

(21) Appl. No.: 17/071,284

(22) Filed: Oct. 15, 2020

(65) Prior Publication Data

US 2021/0135342 A1 May 6, 2021

(30) Foreign Application Priority Data

Oct. 30, 2019 (IN) ..... 201941043881

(51) Int. Cl.

| | |
|---|---|
| ***H01Q 1/24*** | (2006.01) |
| ***H01Q 3/34*** | (2006.01) |
| ***H01Q 21/06*** | (2006.01) |
| ***H01Q 21/26*** | (2006.01) |
| *H01Q 3/38* | (2006.01) |
| *H01Q 3/32* | (2006.01) |
| *H01Q 3/26* | (2006.01) |

(52) U.S. Cl.

CPC ..... *H01Q 1/246* (2013.01); *H01Q 3/34* (2013.01); *H01Q 21/061* (2013.01); *H01Q 21/26* (2013.01); *H01Q 3/2688* (2013.01); *H01Q 3/32* (2013.01); *H01Q 3/38* (2013.01)

(58) Field of Classification Search

CPC ..... H01Q 1/246; H01Q 3/34; H01Q 21/061; H01Q 21/26; H01Q 3/32; H01Q 3/2688; H01Q 3/38

See application file for complete search history.

(56) References Cited

U.S. PATENT DOCUMENTS

2020/0373663 A1* 11/2020 Xu ..... B60N 2/0232

* cited by examiner

*Primary Examiner* — Joseph J Lauture

(74) *Attorney, Agent, or Firm* — Myers Bigel, P.A.

(57) ABSTRACT

A base station antenna includes a remote electronic tilt ("RET") actuator, a phase shifter having a moveable element and a mechanical linkage extending between the RET actuator and the phase shifter. The mechanical linkage includes a RET rod. An adjustable RET rod support includes a base member and an adjustable member, the adjustable member has a RET rod holder and is movably mounted to the base member.

20 Claims, 13 Drawing Sheets

REMOTE ELECTRONIC TILT BASE STATION ANTENNAS HAVING ADJUSTABLE RET ROD SUPPORTS

CROSS-REFERENCE TO RELATED APPLICATION

The present application claims priority to Indian Patent Application No. 201941043881, filed Oct. 30, 2019, the entire content of which is incorporated herein by reference as if set forth fully herein.

BACKGROUND

The present invention relates to cellular communication systems and, in particular, to base station antennas having remote electronic tilt capabilities. Cellular communications systems are used to provide wireless communications to fixed and mobile subscribers. A cellular communications system may include a plurality of base stations that each provide wireless cellular service for a specified coverage area that is typically referred to as a "cell." Each base station may include one or more base station antennas that are used to transmit radio frequency ("RF") signals to, and receive RF signals from, the subscribers that are within the cell served by the base station. Base station antennas are directional devices that can concentrate the RF energy that is transmitted in or received from certain directions. The "gain" of a base station antenna in a given direction is a measure of the ability of the antenna to concentrate the RF energy in that direction. The "radiation pattern" of a base station antenna (also referred to as an "antenna beam") is a compilation of the gain of the antenna across all different directions. Each antenna beam may be designed to service a pre-defined coverage area such as the cell or a portion thereof that is referred to as a "sector." Each antenna beam may be designed to have minimum gain levels throughout the pre-defined coverage area, and to have much lower gain levels outside of the coverage area to reduce interference between neighboring cells/sectors. Base station antennas typically comprise a linear or two dimensional array of radiating elements such as patch, dipole or crossed dipole radiating elements. Many base station antennas now include multiple arrays of radiating elements, each of which generates its own antenna beam.

Early base station antennas generated antenna beams having fixed shapes, meaning that once a base station antenna was installed, its antenna beam(s) could not be changed unless a technician physically reconfigured the antenna. Many modern base station antennas now have antenna beams that can be electronically reconfigured from a remote location. The most common way in which an antenna beam may be reconfigured electronically is to change the pointing direction of the antenna beam (i.e., the direction in which the antenna beam has the highest gain), which is referred to as electronically "steering" the antenna beam. An antenna beam may be steered horizontally in the azimuth plane and/or vertically in the elevation plane. An antenna beam can be electronically steered by transmitting control signals to the antenna that cause the antenna to alter the phases of the sub-components of the RF signals that are transmitted and received by the individual radiating elements of the array that generates the antenna beam. Most modern base station antennas are configured so that the elevation or "tilt" angle of the antenna beams generated by the antenna can be electronically altered. Such antennas are commonly referred to as remote electronic tilt ("RET") antennas.

In order to electronically change the down tilt angle of an antenna beam generated by a linear array of radiating elements, a phase taper may be applied across the radiating elements of the array. Such a phase taper may be applied by adjusting the settings on a phase shifter that is positioned along the RF transmission path between a radio and the individual radiating elements of the linear array. One widely-used type of phase shifter is an electromechanical "wiper" phase shifter that includes a main printed circuit board and a "wiper" printed circuit board that may be rotated above the main printed circuit board. Such wiper phase shifters typically divide an input RF signal that is received at the main printed circuit board into a plurality of sub-components, and then couple at least some of these sub-components to the wiper printed circuit board. The sub-components of the RF signal may be coupled from the wiper printed circuit board back to the main printed circuit board along a plurality of arc-shaped traces, where each arc has a different diameter. Each end of each arc-shaped trace may be connected to a respective sub-group of radiating elements that includes at least one radiating element. By physically (mechanically) rotating the wiper printed circuit board above the main printed circuit board, the locations where the sub-components of the RF signal couple back to the main printed circuit board may be changed, which thus changes the lengths of the transmission paths from the phase shifter to the respective sub-groups of radiating elements. The changes in these path lengths result in changes in the phases of the respective sub-components of the RF signal, and since the arcs have different radii, the phase changes along the different paths will be different. Typically, the phase taper is applied by applying positive phase shifts of various magnitudes (e.g., +X°, +2X° and +3X°) to some of the sub-components of the RF signal and by applying negative phase shifts of the same magnitudes (e.g., −X°, −2X° and −3X°) to additional of the sub-components of the RF signal. Exemplary phase shifters of this variety are discussed in U.S. Pat. No. 7,907,096 to Timofeev, the disclosure of which is hereby incorporated herein in its entirety. The wiper printed circuit board is typically moved using an electromechanical actuator such as a DC motor that is connected to the wiper printed circuit board via a mechanical linkage. These actuators are often referred to as "RET actuators." Both individual RET actuators that drive a single mechanical linkage and "multi-RET actuators" that have a plurality of output members that drive a plurality or respective mechanical linkages are commonly used in base station antennas.

SUMMARY

Pursuant to embodiments of the present invention, a base station antenna comprises a remote electronic tilt ("RET") actuator; a phase shifter having a moveable element; a mechanical linkage extending between the RET actuator and the phase shifter, the mechanical linkage including a RET rod; and an adjustable RET rod support comprising a base member and an adjustable member, the adjustable member comprising a RET rod holder and being movably mounted relative to the base member.

The base member may comprise a mounting structure configured to mount the adjustable RET rod support to a backplane. The distance of the RET rod holder relative to the backplane is variable. The mounting structure may comprise laterally extending flanges that set against an exposed surface of the backplane. A bore may be formed in the bottom of the base member. A pair of transverse slots may be formed in the bottom of the base member. The mounting structure may also comprise a connector that includes an extending cylinder, the cylinder being fit into the bore with the backplane trapped between the base member and the connector. The connector may also include a pair of stepped flanges, the stepped flanges being fit into the transverse slots. The connector may extend through an aperture in the backplane. The base member may comprise an upright that extends from the mounting structure. The upright may define a cavity having an effective diameter. The cavity may extend generally perpendicular to the backplane. An open end of the cavity may comprise a split wall structure. The split wall structure may comprise a notch that extends from a distal end of upright. The notch may create two facing end portions in the upright. The two facing end portions may be compressed toward one another in a locked position to decrease the effective diameter of the cavity. A locking member may hold the upright in the compressed, locked positon. The locking member may comprise a deformable tang. A ratcheting structure may be provided in the cavity. The ratcheting structure may comprise a series of first ridges formed on the interior surface of cavity. The first ridges may extend generally transversely to the direction of the travel of the adjustable member. The first ridges may extend around the periphery of cavity. The first ridges may be formed as at least one of a series of teeth and bumps that create alternating raised portions and recessed portions that define stop positons for the adjustable member. The first ridges in the cavity may engage mating second ridges on the adjustable member to create a mechanical interlock when the upright is in the locked positon. The two facing end portions of the member in the uncompressed position may define an unlocked positon. When the upright is in the unlocked position, the second ridges on the adjustable member and the first ridges in the cavity may ride over one another such that the adjustable member is movable linearly in the cavity without rotating the adjustable member. The adjustable member may comprise a shaft that is dimension to slidably fit within the cavity when the upright is in the unlocked configuration. The second ridges may be on the shaft. The second ridges may extend generally transversely to the direction of travel of the adjustable member in the cavity. The shaft may support the RET rod holder. The RET rod holder may comprise a pair of opposed arms, the distal ends of the pair of opposed arms may be spaced from one another to create an opening for receiving the RET rod. A cavity may be formed on one of the base member and the adjustable member and a shaft may be slidably received in the cavity that is formed on the other one of the adjustable member and the base member. The cavity and the shaft may comprise a mating ratcheting structure. The mating ratcheting structure may comprise a first plurality of ridges on the shaft and a second plurality of ridges in the cavity. The first and second ridges may be formed as at least one of a series of teeth and bumps that create alternating raised portions and recessed portions that define stop positons for the adjustable member. The first and second ridges may be formed as mating screwthreads. The first and second ridges may be formed as mating screwthreads such that movement of the adjustable member relative to the base member is effected by rotating the adjustable member relative to the base member to screw the adjustable member into or out of the base member. The RET rod holder may be pivotably mounted on the shaft. A second adjustable member may be positioned between the adjustable member and the base member. The second adjustable member, the adjustable member and the base member may be telescopically mounted to one another. The ratcheting structure may comprise a projection or a series of projections on one of the shaft and the receptacle that engage a detent, recess or aperture or a series of detents, recesses or apertures on the other one of the shaft or the receptacle.

DETAILED DESCRIPTION

Figure 1A:
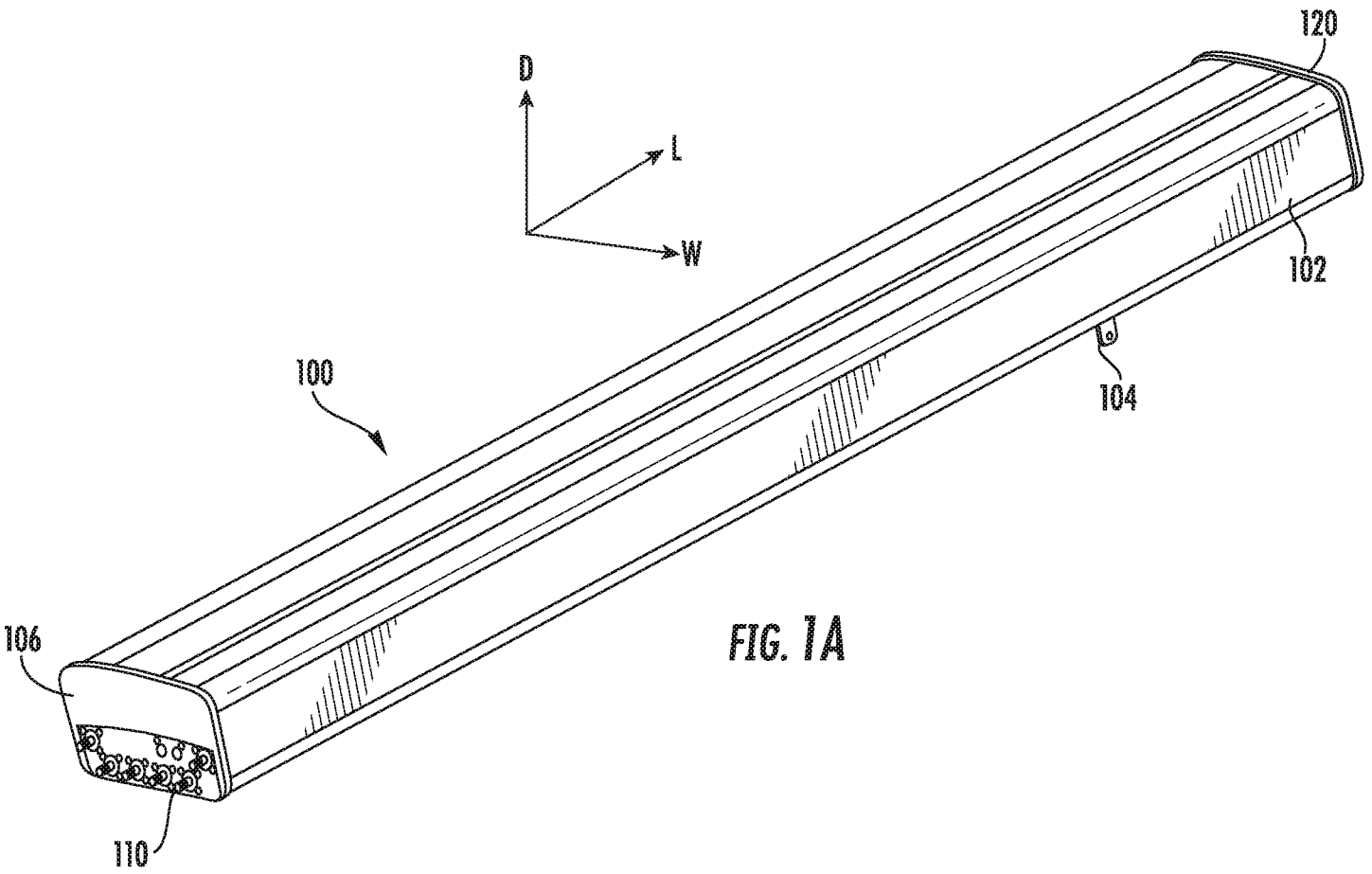
FIG. 1A is a perspective view of an example RET base station antenna according to embodiments of the present invention.

Modern base station antennas often include two, three or more linear arrays of radiating elements, where each linear array has an electronically adjustable down tilt. The linear arrays typically include cross-polarized radiating elements, and a separate phase shifter is provided for electronically adjusting the down tilt of the antenna beam for each polarization. In order to change the downtilt angle of an antenna beam generated by a linear array on a base station antenna, a control signal may be transmitted to the antenna that causes a RET actuator associated with the linear array to generate a desired amount of movement in an output member thereof. The movement may comprise, for example, linear movement or rotational movement. A mechanical linkage is used to translate the movement of the output member of the RET actuator to movement of a moveable element of a phase shifter (e.g., a wiper arm) associated with the linear array. Accordingly, each mechanical linkage may extend between the output member of the RET actuator and the moveable element of the phase shifter.

In some embodiments, the mechanical linkage may comprise a series of longitudinally-extending plastic or fiberglass RET rods that may be connected by RET linkages that extend in the width and/or depth directions of the antenna. The RET linkages may connect the RET rods to each other and/or to the RET actuator or the phase shifter. Multiple RET rods are often used because the output members of the RET actuators are often not aligned with the input members of the associated phase shifter in either or both the width or depth directions. Thus, for example, the mechanical linkage may include a first RET rod that is attached to the output member of a RET actuator and a second RET rod that is attached to the input member of a phase shifter where the first and second RET rods are connected to one another by a RET linkage. The RET linkages may thus be used to form "jogs" in the mechanical linkage for either or both alignment and/or routing purposes. In many cases, three or even four RET rods may be included within a single mechanical linkage. As a result, a beam-shaping base station antenna typically includes a large number of RET rods where the RET rods span relatively long distances.

Moreover, depending on the type of antenna, the type of RET actuator, the type of phase shifter, and the layout and geometry of the antenna, the height of each RET rod above the antenna backplane tends to vary. As used herein terms such as "height" and "above the antenna backplane" refer to the distance between the back side of the backplane and the RET rod. In actual use of the antenna, the antenna is typically disposed generally vertically relative to eh horizon such that the backplane is also disposed generally vertically. As a result, the height of the RET rod above the backplane is a generally horizontal dimension as the antenna is used. As described herein, the distance between the back side of the backplane and the RET rod or RET rod holder or the length of the RET rod holder may be referred to herein as "height" regardless of the spatial orientation of the antenna. Because of the length and material of the RET rod, the RET rod may tend to bend or sag along its length if left unsupported. As a result, RET rod supports have been provided, spaced along the length of the RET rod, to support and guide the RET rods. However, because the height of the RET rods above the backplane varies, it has been necessary to provide RET rod supports in a wide variety of heights to accommodate different antenna layouts. RET rod support heights may range from about 5 mm to about 50 mm with RET rod supports being provided in at least some antennas of heights of 5.5 mm, 8.75 mm, 8.8 mm, 11.1 mm, 11.2 mm, 12.13 mm, 12.5 mm, 20.27 mm, 24.71 mm, 28.93 mm, 31.6 mm, 33.9 mm, 35.27 mm, 39.2 mm, 39.34 mm, 41.8 mm, and 49.48 mm. As a result, the inventory part count for a base station antenna manufacturer is high, thereby increasing the cost of the antenna. Moreover, the large number of parts also is a logistical burden. The large number of parts also increases manufacturing complexity.

Pursuant to embodiments of the present invention, base station antennas are provided that include adjustable RET rod supports that can dramatically reduce the number of parts that a particular base station antenna manufacturer needs to maintain in inventory. The adjustable RET rod supports according to embodiments of the present invention may include a first member that is configured to be mounted on the antenna backplane and a second member that is configured to connect to and support a RET rod. The first member and the second member are movable relative to one another to adjust the height of the RET rod support relative to the backplane to thereby accommodate a wide variety of RET antenna designs and configurations.

In some embodiments, the first and second members are linearly slidable relative to one another. In other embodiments, the first and second members may be coupled by a threaded connection such that the rotation of the first and second members relative to one another adjusts the height of the RET rod support. A locking mechanism may be provided to fix the position of the first and second members relative to one another after the height of the RET rod support is properly set. As a result, a small number, and in some situations a single, RET rod support may be used to support the RET rods in different antenna configurations. This allows antenna manufacturers to hold many fewer parts in inventory, reduce the number of RET rod supports that a base station antenna manufacturer need design and develop, and may avoid the need to design and fabricate new RET rod supports each time a new antenna is designed.

Pursuant to further embodiments of the present invention, adjustable RET rod supports may be provided using standardized parts. The standardized parts may comprise, for example, injection molded plastic parts, metal parts that are stamped and/or bent from sheet metal or combinations of such materials. The adjustable RET rod support may be used across a wide variety of different base station antenna designs, and hence may be manufactured in very high volumes.

Embodiments of the present invention will now be discussed in greater detail with reference to the drawings. In some cases, two-part reference numerals are used in the drawings. Herein, elements having such two-part reference numerals may be referred to individually by their full reference numeral (e.g., linear array 120-2) and may be referred to collectively by the first part of their reference numerals (e.g., the linear arrays 120).

Figure 1B:
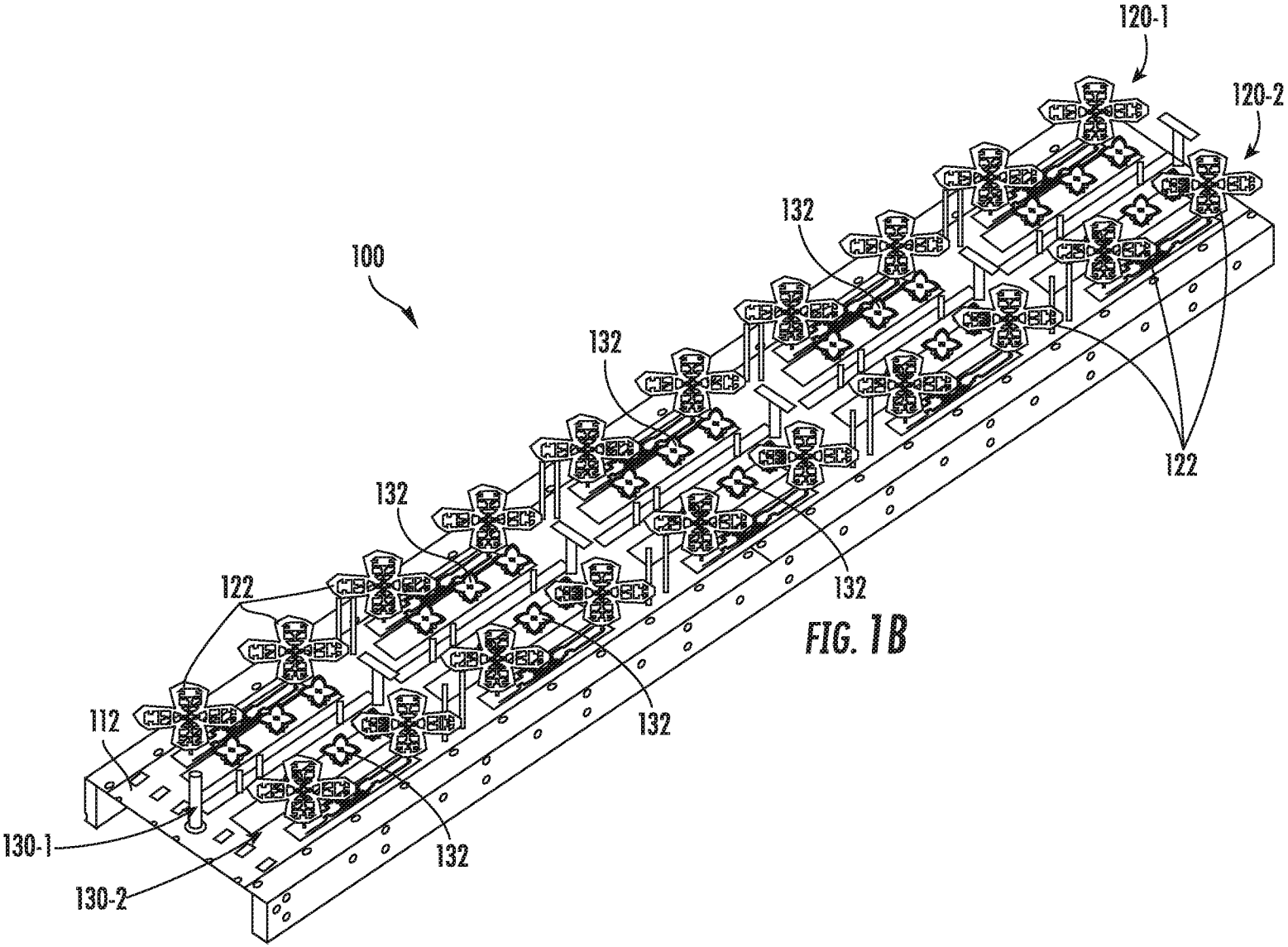
FIG. 1B is a perspective view of the RET base station antenna of FIG. 1A with the radome thereof removed.

FIG. 1A is a perspective view of a RET base station antenna 100 according to embodiments of the present invention. FIG. 1B is a perspective view of the base station antenna 100 with the radome removed to show the four linear arrays of radiating elements that are included in antenna 100. It is to be understood that the adjustable RET rod supports as described herein may be used in, and are intended to be used in, a wide variety of antenna configurations in addition to the embodiment specifically described herein. The RET antenna 100 includes a radome 102, at least one mounting bracket 104, a bottom end cap 106 and a top end cap 108. A plurality of input/output ports 110 are mounted in the bottom end cap 106. Coaxial cables (not shown) may be connected between the input/output ports 110 and the RF ports on one or more radios (not shown). These coaxial cables may carry RF signals between the radios and the base station antenna 100. The input/output ports 110 may also include control ports that carry control signals to the base station antenna 100 from a controller that is located remotely from base station antenna 100. These control signals may include control signals for electronically changing the tilt angle of the antenna beams generated by the base station antenna 100.

For ease of reference, FIG. 1A includes a coordinate system that defines the length (L), width (W) and depth (D) axes (or directions) of the base station antenna 100 that will be discussed throughout the application. Typically, the longitudinal axes of the RET rods extend along the length (L) and the longitudinal axis of the adjustable RET rod supports extend along the depth (D).

FIG. 1B is a perspective view of the base station antenna of FIG. 1A with the radome 102 removed. As shown in FIG. 1B, the base station antenna 100 includes two linear arrays 120-1, 120-2 of low-band radiating elements 122 (i.e., radiating elements that transmit and receive signals in a lower frequency band) and two linear arrays 130-1, 130-2 of high-band radiating elements 132 (i.e., radiating elements that transmit and receive signals in a higher frequency band). Each of the low-band radiating elements 122 is implemented as a cross-polarized radiating element that includes a first dipole that is oriented at an angle of −45° with respect to the azimuth plane and a second dipole that is oriented at an angle of +45° with respect to the azimuth plane. Similarly, each of the high-band radiating elements 132 is implemented as a cross-polarized radiating element that includes a first dipole that is oriented at an angle of −45° with respect to the azimuth plane and a second dipole that is oriented at an angle of +45° with respect to the azimuth plane. Since cross-polarized radiating elements are provided, each linear array 120-1, 120-2, 130-1, 130-2 will generate two antenna beams, namely a first antenna beam generated by the −45° dipoles and a second antenna beam generated by the +45° dipoles. The radiating elements 122, 132 extend forwardly from a backplane 112 with may comprise, for example, a sheet of metal that serves as a ground plane for the radiating elements 122, 132 and/or a reflector.

Figure 2:
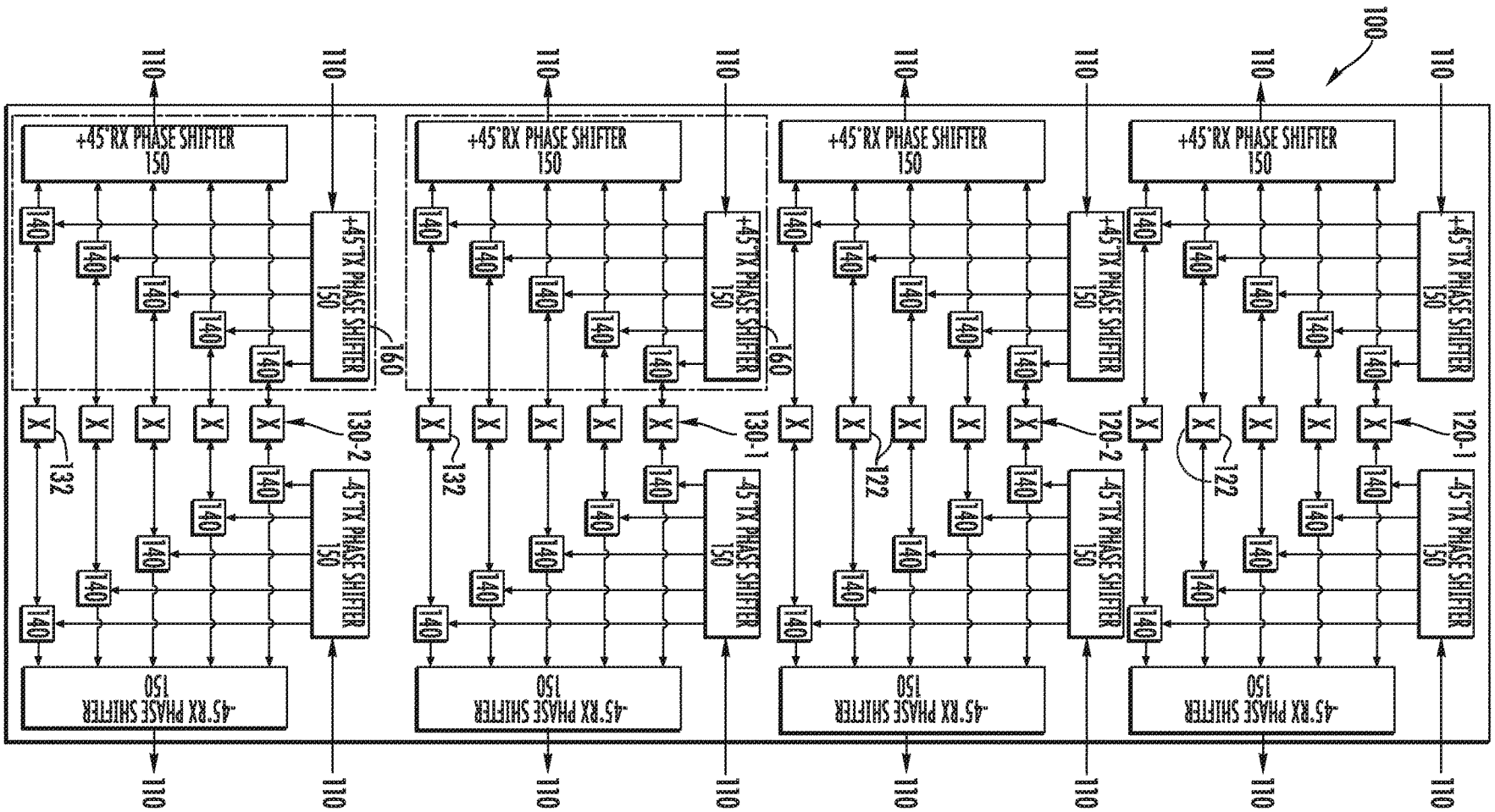
FIG. 2 is a schematic block diagram illustrating the electrical connections between various components of the RET base station antenna of FIGS. 1A-1B.

FIG. 2 is a schematic block diagram illustrating various additional components of the RET antenna 100 and the electrical connections therebetween. It should be noted that FIG. 2 does not show the actual location of the various elements on the antenna 100, but instead is drawn to merely show the electrical transmission paths between the various elements.

As shown in FIG. 2, each input/output port 110 may be connected to a phase shifter 150. The base station antenna 100 performs duplexing between the transmit and receive sub-bands for each linear array 120, 130 within the antenna (which allows different downtilts to be applied to the transmit and receive sub-bands), and hence each linear array 120, 130 includes both a transmit (input) port 110 and a receive (output) port 110. A first end of each transmit port 110 may be connected to the transmit port of a radio (not shown) such as a remote radio head. The other end of each transmit port 110 is coupled to a transmit phase shifter 150. Likewise, a first end of each receive port 110 may be connected to the receive port of a radio (not shown), and the other end of each receive port 110 is coupled to a receive phase shifter 150. Two transmit ports, two receive ports, two transmit phase shifters and two receive phase shifters are provided for each linear array 120, 130 to handle the two different polarizations.

Each transmit phase shifter 150 divides an RF signal input thereto into five sub-components, and applies a phase taper to these sub-components that sets the tilt (elevation) angle of the antenna beam generated by an associated linear array 120, 130 of radiating elements 122, 132. The five outputs of each transmit phase shifter 150 are coupled to five respective duplexers 140 that pass the sub-components of the RF signal output by the transmit phase shifter 150 to five respective sub-arrays of radiating elements 122, 132. In the example antenna 100 shown in FIGS. 1A, 1B and 2, each low-band linear array 120 includes ten low-band radiating elements 122 that are grouped as five sub-arrays of two radiating elements 122 each. Each high-band linear array 130 includes fifteen high-band radiating elements 132 that are grouped as five sub-arrays of three radiating elements 132 each. In FIG. 2, the boxes labelled 122, 132 represent sub-arrays of radiating elements.

Each sub-array of radiating elements passes received RF signals to a respective one of the duplexers 140, which in turn route those received RF signals to the respective inputs of an associated receive phase shifter 150. The receive phase shifter 150 applies a phase taper to each received RF signal input thereto that sets the tilt angle for the receive antenna beam and then combines the received RF signals into a composite RF signal. The output of each receive phase shifter 150 is coupled to a respective receive port 110.

While FIGS. 1B and 2 show an antenna having two linear arrays 120 of ten low-band radiating elements 122 each and two linear arrays 130 of fifteen high-band radiating elements 132 each, it will be appreciated that the number of linear arrays 120, 130 and the number of radiating elements 122, 132 included in each of the linear array 120, 130 may be varied. It will also be appreciated that duplexing may be done in the radios instead of in the antenna 100, that the number(s) of radiating elements 122, 132 per sub-array may be varied, that different types of radiating elements may be used (including single polarization radiating elements) and that numerous other changes may be made to the base station antenna 100 without departing from the scope of the present invention.

As can be seen from FIG. 2, the base station antenna 100 may include a total of sixteen phase shifters 150. While the two transmit phase shifters 150 for each linear array 120, 130 (i.e., one transmit phase shifter 150 for each polarization) may not need to be controlled independently (and the same is true with respect to the two receive phase shifters 150 for each linear array 120, 130), there still are eight sets of two phase shifters 150 that should be independently controllable. Accordingly, at least eight mechanical linkages may be required to connect the eight sets of phase shifters 150 to respective RET actuators. As explained above, the mechanical linkages often include multiple RET rods to allow for "jogs" in the mechanical linkage for either or both alignment and/or routing purposes.

Each phase shifter 150 shown in FIG. 2 may be implemented, for example, as a rotating wiper phase shifter. The phase shifts imparted by a phase shifter 150 to each sub-component of an RF signal may be controlled by a mechanical positioning system that physically changes the position of the rotating wiper of each phase shifter 150, as will be explained with reference to FIG. 3. It will be appreciated that other types of phase shifters may be used instead rotating wiper phase shifters such as, for example, trombone phase shifters, sliding dielectric phase shifters and the like.

Figure 3:
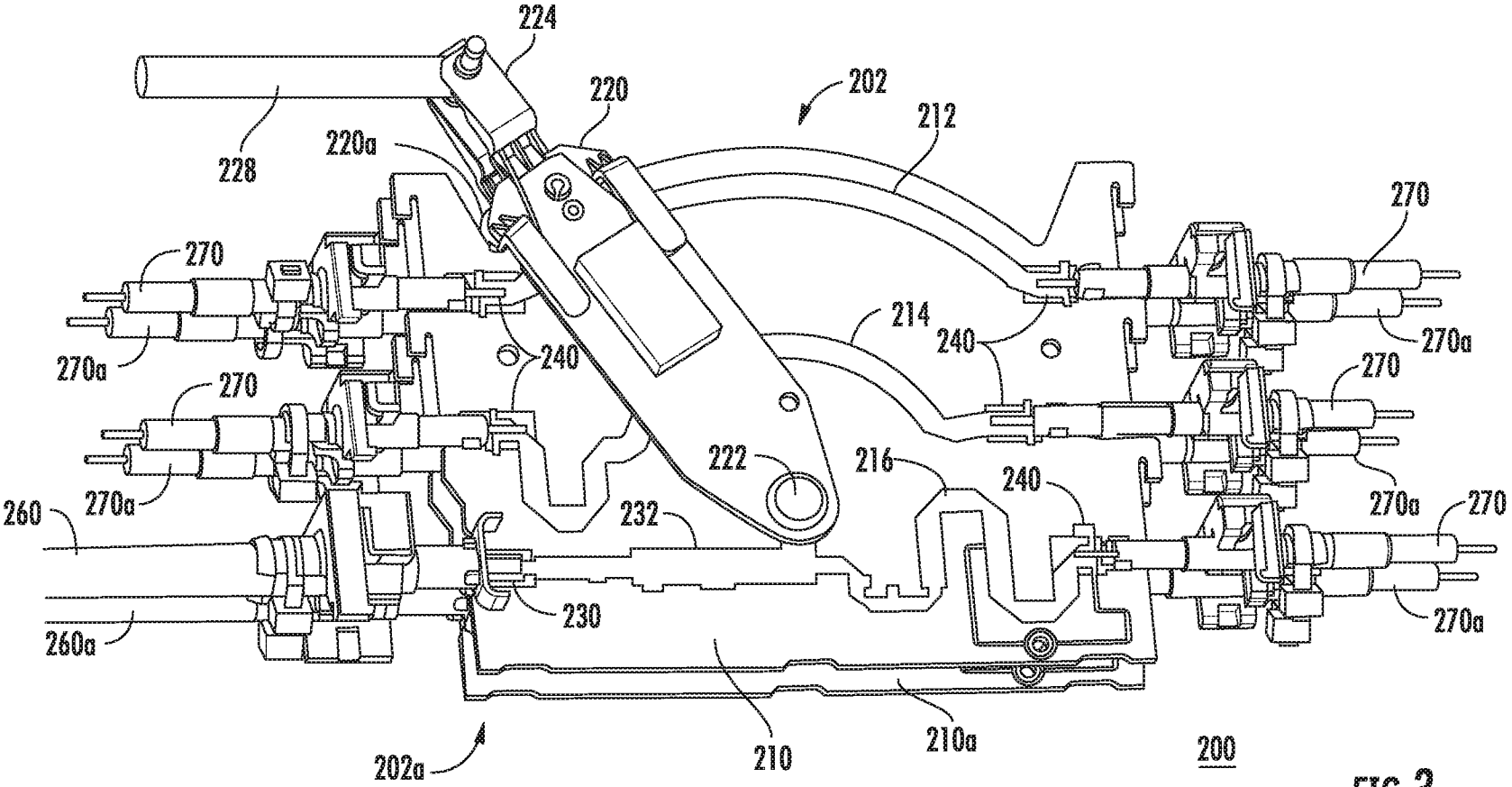
FIG. 3 is a front perspective view of a pair of electromechanical phase shifters that may be included in the RET base station antenna of FIGS. 1A-1B.

Referring to FIG. 3, a dual rotating wiper phase shifter assembly 200 is illustrated that may be used to implement, for example, two of the phase shifters 150 of FIG. 2. The dual rotating wiper phase shifter assembly 200 includes first and second phase shifters 202, 202*a*. In the description of FIG. 3 that follows it is assumed that the two phase shifters 202, 202*a* are each transmit phase shifters that have one input and five outputs. It will be appreciated that if the phase shifters 202, 202*a* are instead used as receive phase shifters then the terminology changes, because when used as receive phase shifters there are five inputs and a single output.

As shown in FIG. 3, the dual phase shifter 200 includes first and second main (stationary) printed circuit boards 210, 210*a* that are arranged back-to-back as well as first and second rotatable wiper printed circuit boards 220, 220*a* (wiper printed circuit board 220*a* is barely visible in the view of FIG. 3) that are rotatably mounted on the respective main printed circuit boards 210, 210*a*. The wiper printed circuit boards 220, 220*a* may be pivotally mounted on the respective main printed circuit boards 210, 210*a* via a pivot pin 222. The wiper printed circuit boards 220, 220*a* may be joined together at their distal ends via a bracket 224.

The position of each rotatable wiper printed circuit boards 220, 220*a* above its respective main printed circuit board 210, 210*a* is controlled by the position of a drive shaft 228 (partially shown in FIG. 3). The drive shaft 228 may constitute part or all of the mechanical linkage connecting the RET actuator to the phase shifter. In the present embodiment, the drive shaft 228 comprises a RET rod. In some embodiments, a linkage may connect the RET rod to the wiper printed circuit boards 220, 220*a*.

Each main printed circuit board 210, 210*a* includes transmission line traces 212, 214. The transmission line traces 212, 214 are generally arcuate. In some cases the arcuate transmission line traces 212, 214 may be disposed in a serpentine pattern to achieve a longer effective length. In the example illustrated in FIG. 3, there are two arcuate transmission line traces 212, 214 per main printed circuit board 210, 210*a* (the traces on printed circuit board 210*a* are not visible in FIG. 3), with the first arcuate transmission line trace 212 being disposed along an outer circumference of each printed circuit board 210, 210*a*, and the second arcuate transmission line trace 214 being disposed on a shorter radius concentrically within the outer transmission line trace 212. A third transmission line trace 216 on each main printed circuit board 210, 210*a* connects an input pad 230 on each main printed circuit board 210, 210*a* to an output pad 240 that is not subjected to an adjustable phase shift.

The main printed circuit board 210 includes one or more input traces 232 leading from the input pad 230 near an edge of the main printed circuit board 210 to the position where the pivot pin 222 is located. RF signals on the input trace 232 are coupled to a transmission line trace (not visible in FIG. 3) on the wiper printed circuit board 220, typically via a capacitive connection. The transmission line trace on the wiper printed circuit board 220 may split into two secondary transmission line traces (not shown). The RF signals are capacitively coupled from the secondary transmission line traces on the wiper printed circuit board 220 to the transmission line traces 212, 214 on the main printed circuit board. Each end of each transmission line trace 212, 214 may be coupled to a respective output pad 240. A coaxial cable 260 or other RF transmission line component may be connected to input pad 230. A respective coaxial cable 270 or other RF transmission line component may be connected to each respective output pad 240. As the wiper printed circuit board 220 moves, an electrical path length from the input pad 230 of phase shifter 202 to each output pad 240 changes. For example, as the wiper printed circuit board 220 moves to the left it shortens the electrical length of the path from the input pad 230 to the output pad 240 connected to the left side of transmission line trace 212 (which connects to a first sub-array of radiating elements), while the electrical length from the input pad 230 to the output pad 240 connected to the right side of transmission line trace 212 (which connects to a second sub-array of radiating elements) increases by a corresponding amount. These changes in path lengths result in phase shifts to the signals received at the output pads 240 connected to transmission line trace 212 relative to, for example, the output pad 240 connected to transmission line trace 216.

The second phase shifter 202*a* may be identical to the first phase shifter 202. As shown in FIG. 3, the rotating wiper printed circuit board 220*a* of phase shifter 202*a* may be controlled by the same drive shaft 228 as the rotating wiper printed circuit board 220 of phase shifter 202.

Figure 4:
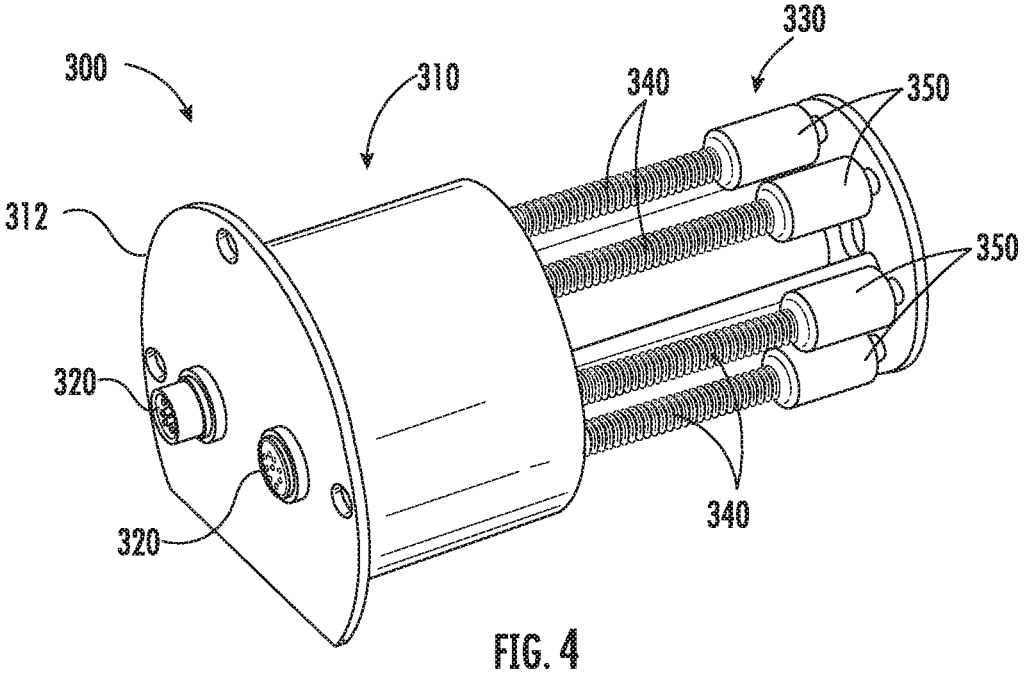
FIG. 4 is perspective view of a multi-RET actuator that may be included in the RET base station antenna of FIGS. 1A-1B.

As noted above, a RET actuator is used to drive the moveable element of a phase shifter. FIG. 4 is a perspective view of an example RET actuator 300 that may be used in the base station antennas according to embodiments of the present invention, although the configuration of the RET actuator may vary from that as specifically shown. The RET actuator 300 is a multi-RET actuator that includes multiple output members that can drive multiple respective mechanical linkages.

As shown in FIG. 4, the multi-RET actuator 300 includes a housing 310 and a pair of connectors 320 that are mounted so as to extend through the housing 310. The connectors 320 may connect to communications cables that may be used to deliver control signals from a base station control system to the multi-RET actuator 300.

The multi-RET actuator 300 further includes eight generally parallel worm gear shafts 340 that extend along respective parallel axes (only four of the worm gear shafts 340 are visible in FIG. 4). The worm gear shafts 340 are rotatably mounted in the housing 310. A drive motor (not shown) may be mounted in the housing 310 that may be used to rotate a selected one of the worm gear shafts 340. Various selection mechanisms may also be mounted within the housing 310 that may be used to select one of the worm gear shafts 340 so that the drive motor is operatively connected to the selected worm gear shaft 340.

An internally threaded piston 350 is mounted on each worm gear shaft 340 and is configured (e.g., via threads) to move axially relative to the worm gear shaft 340 upon rotation of the worm gear shaft 340. Each piston 350 may be connected to a mechanical linkage (not shown in FIG. 4) that connects the piston 350 to a moveable element on one or more phase shifters of the antenna, such that axial movement of the piston 350 can be used to apply a phase taper to the sub-components of RF signals that are transmitted and received through a linear array of the antenna. Each piston 350 may be moved in either direction along its associated worm gear shaft 340 by changing the direction of rotation of the worm gear shaft 340. The linear movement of the pistons 350 is transmitted to the RET rods in the mechanical linkages such that as each piston 350 is moved linearly in either direction along its associated worm gear shaft, the RET rods connected to that piston are also moved linearly in either direction along their longitudinal axis.

Figure 5:
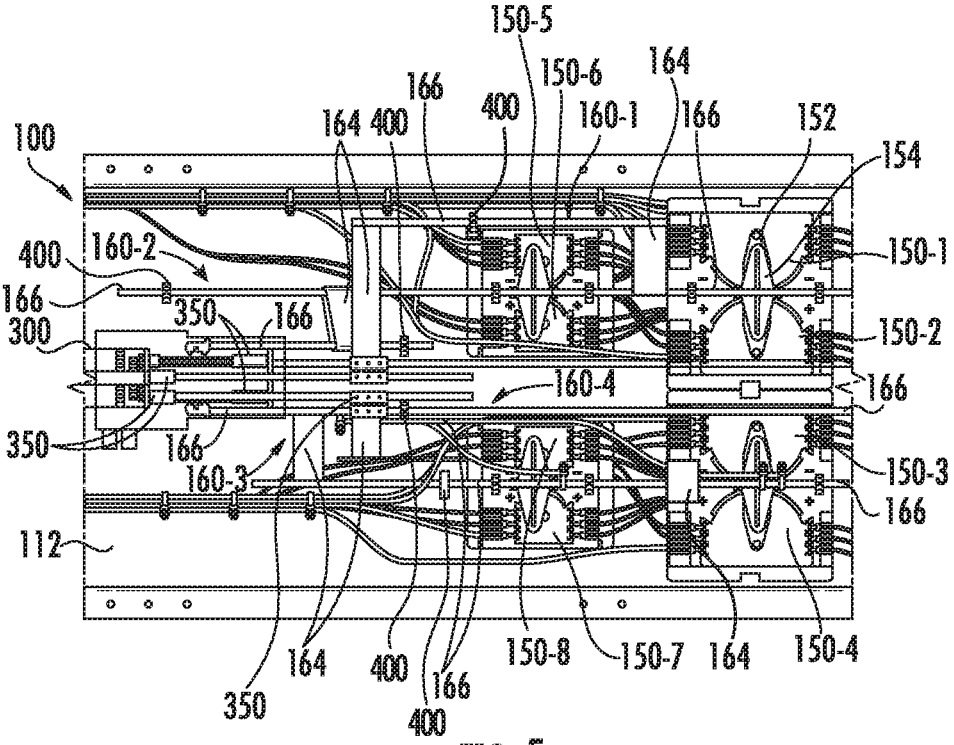
FIG. 5 is a rear view of a portion of the RET base station antenna of FIGS. 1A-1B that shows how mechanical linkages are used to connect the output members of the multi-RET actuator of FIG. 4 to respective ones of the phase shifters illustrated in FIG. 3.

FIG. 5 is a rear view of a portion of the base station antenna 100 that shows how mechanical linkages 160-1, 160-2, 160-3 and 160-4 are used to connect the output members of the RET actuator 300 (i.e., the pistons 350) to moveable elements of respective pairs of phase shifters 150. The multi-RET actuator 300 is mounted in the antenna 100 behind the backplane 112. Eight pairs of phase shifters 150 may be mounted rearwardly of the backplane 112 (only four pairs of phase shifters are visible in FIG. 5). Since the base station antenna 100 has linear arrays 120, 130 that are formed of dual-polarized radiating elements 122, 132, the phase shifters 150 are mounted in pairs since the phase shifter 150 for each polarization will be adjusted the same amount. The RET actuator 300 is connected to the phase shifters 150 by mechanical linkages 160 comprising RET rods 166 and linkages 164.

The mechanical linkages 160 are provided to connect each output member 350 of the multi-RET actuator 300 to a respective pair of phase shifters 150. Each mechanical linkage 160 comprises a plurality of RET rods 166 connected by linkages 164. In some embodiments, a single RET rod may comprise the mechanical linkage while in other embodiments, a greater number of RET rods and linkages may be used. For example, mechanical linkage 160-1 is connected between one of the pistons 350 of RET actuator 300 and a slider 154 of the phase shifter assembly that engages and rotationally moves the respective wiper arms 152 of phase shifters 150-1 and 150-2. As shown in FIG. 5, the mechanical linkage 160-1 includes a first RET rod 166 that is attached to the piston 350 of multi-RET actuator 300, a second RET rod 166, a first RET linkage 164 that connects the first RET rod 166 to the second RET rod 166, and the slider 154 that engages the wiper arms 152 of the phase shifters 150-1, 150-2. The RET rods 166 may comprise, for example, generally rigid fiberglass or plastic longitudinally-extending rods. The other three mechanical linkages 160 shown in FIG. 5 include similar combinations of RET rods 166 and RET linkages 164. The RET rods 166 typically extend in a longitudinal direction of the antenna 100, while the RET linkages 164 typically extend along the width and/or depth axes to connect two RET rods 166 together, and/or to connect a RET rod 166 to an output member of the RET actuator or to a moveable element of a phase shifter assembly. Each mechanical linkage 160 is used to transfer a linear movement of the output member 350 of the RET actuator 300 to a slider 154, although in other embodiments rotational movement may be transferred by the mechanical linkage.

As can be seen from FIG. 5, the mechanical linkages 160 typically include multiple RET rods 166 because the output members of the RET actuator(s) 350 are typically not longitudinally aligned with the moveable elements 152, 154 of the phase shifters 150. Offsets or "jogs" along the width and/or depth axes may also be required in a mechanical linkage 160 in order to route the mechanical linkage 160 around other elements in the antenna 100. Moreover, each RET rod 166 typically spans different distances in the longitudinal direction as compared to other ones of the RET rods 166.

Because the RET rods 166 are not perfectly rigid it is necessary to provide RET rod supports 400 at spaced intervals along the length of the RET rods. The height of the RET rods 166 above the backplane 112 may vary within a single antenna and/or between different types of antennas. Accordingly, the effective height of the RET rod supports 400 must be varied to align with the height of the RET rods 166 above backplane 112. The RET rod support 400 of the invention is adjustable such that a single adjustable RET rod support 400 may be used with RET rods 166 set at various heights above the backplane 112.

Referring to FIGS. 6 through 15, in one embodiment, the RET rod support 400 comprises a first, base member 402 that is secured to the backplane 112 in a position directly under the RET rod 166 to be supported by that RET rod support 400 and a second, movable member 404 that is movably mounted on the base member 402 such that the position of the movable member 404 relative to the base member 402 is adjustable to thereby adjust the height of the RET rod support 400.

Figure 6:
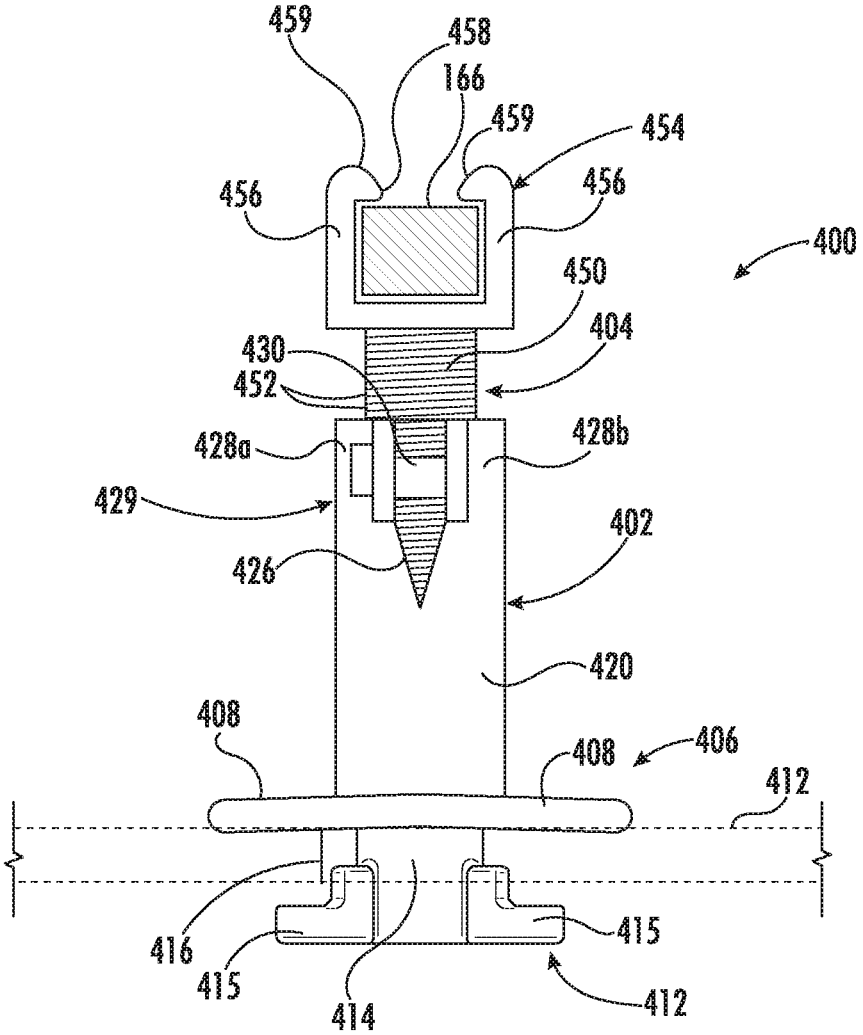
FIG. 6 is a side view of an embodiment of an adjustable RET rod support of the invention.
Figure 7:
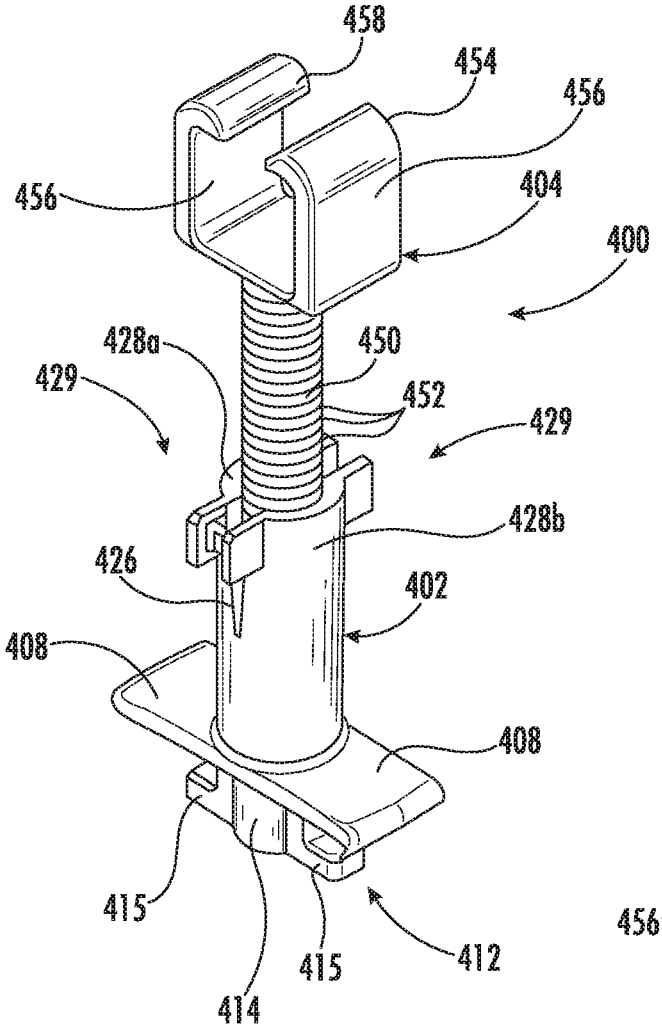
FIG. 7 is a perspective view of the adjustable RET rod support of FIG. 6.
Figure 8:
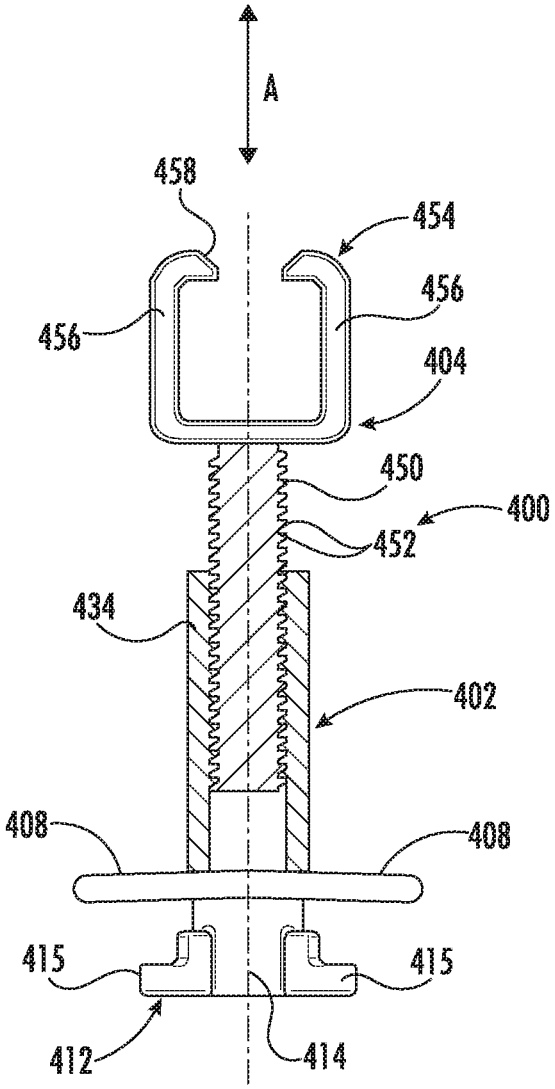
FIG. 8 is a partial section side view of the adjustable RET rod support of FIG. 6.
Figure 9:
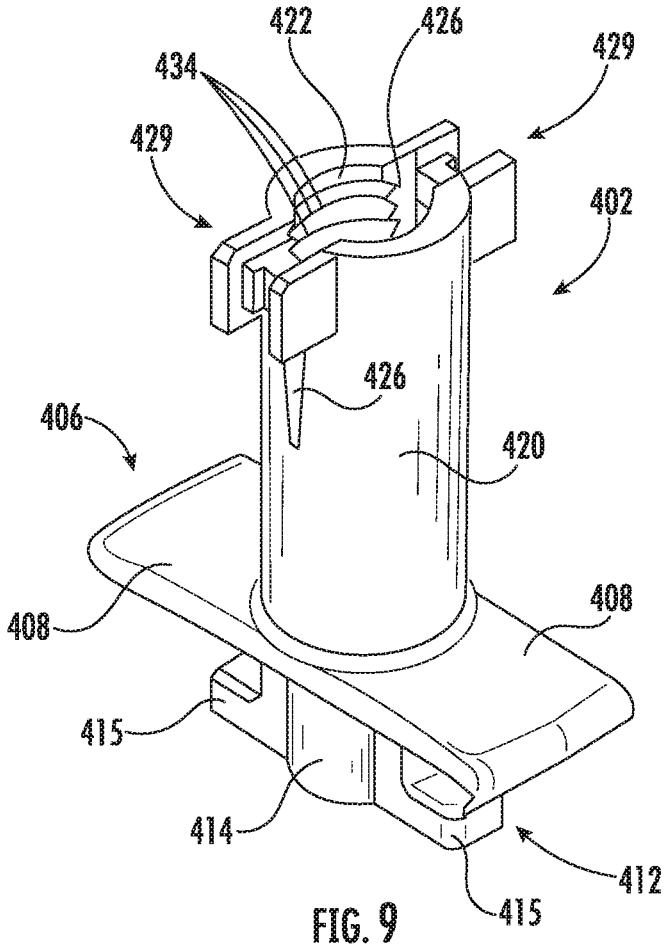
FIG. 9 is a perspective view of the base member of the adjustable RET rod support of FIG. 6.
Figure 10:
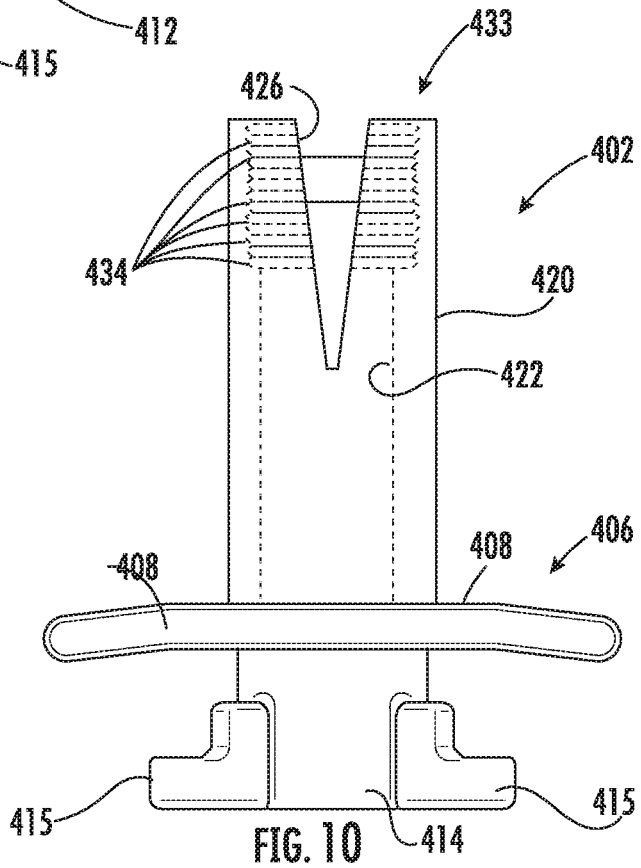
FIG. 10 is a first partial section view of the base member of the adjustable RET rod support of FIG. 6.
Figure 11:
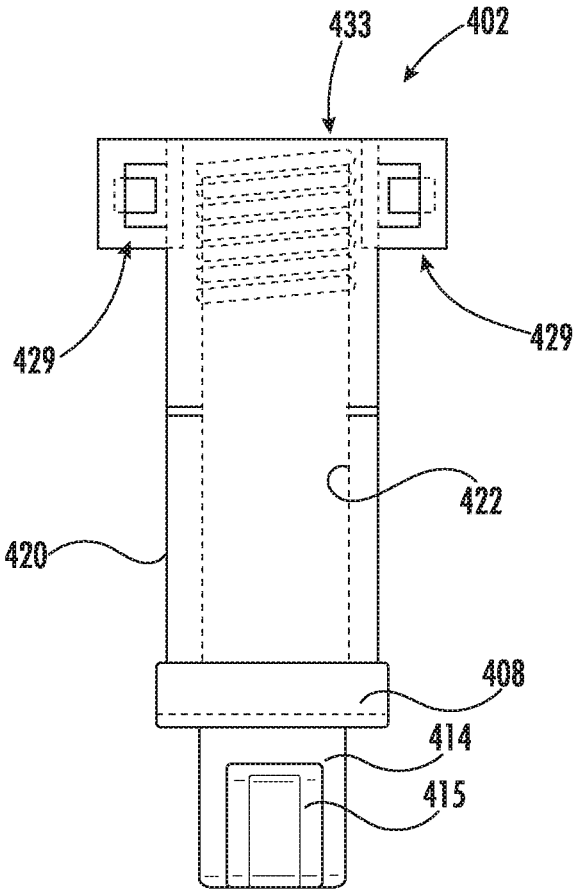
FIG. 11 is a second partial section view of the base member of the adjustable RET rod support of FIG. 6 taken along a plane orthogonal to the plane of FIG. 10.
Figure 12:
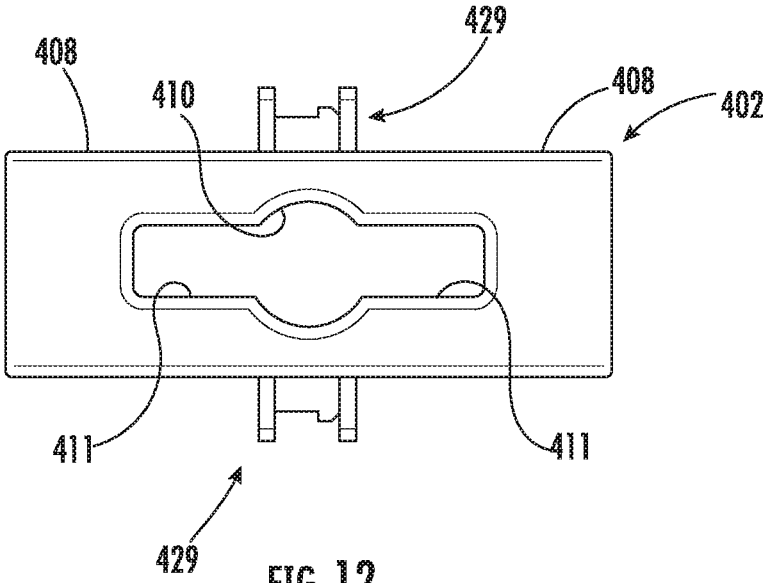
FIG. 12 is a bottom view of the base member of the adjustable RET rod support of FIG. 6.
Figure 13:
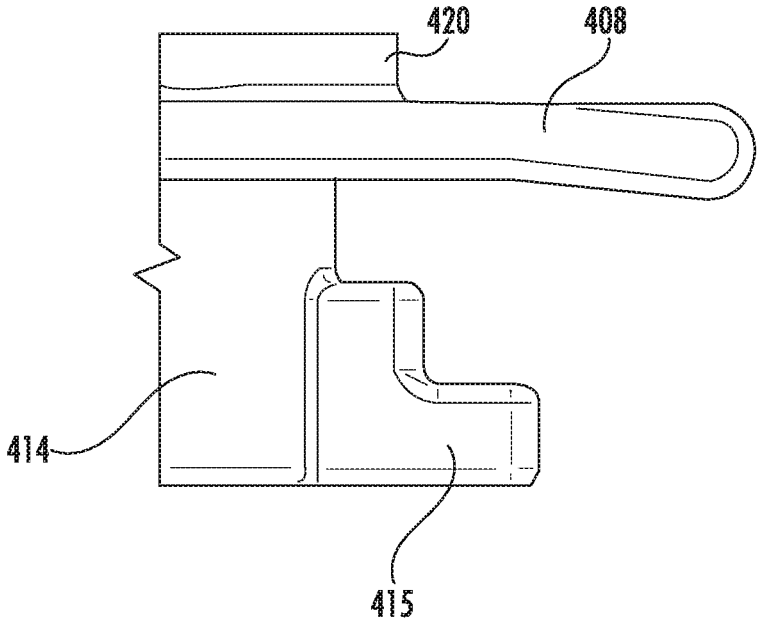
FIG. 13 is a detailed view of area C of FIG. 10.
Figure 14:
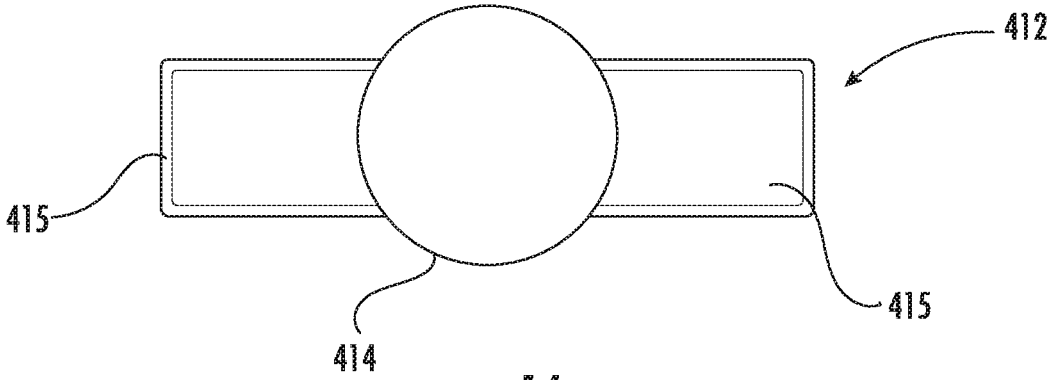
FIG. 14 is a top view of the connector of the adjustable RET rod support of FIG. 6.
Figure 15:
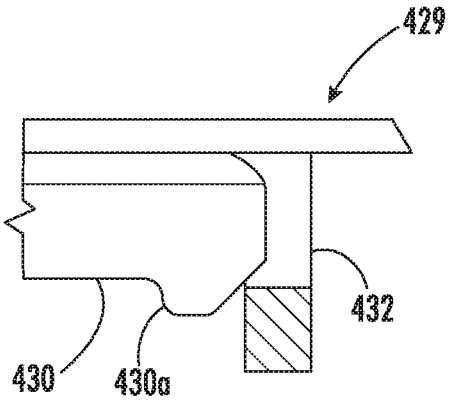
FIG. 15 is a detailed view of area D of FIG. 12.
Figure 16:
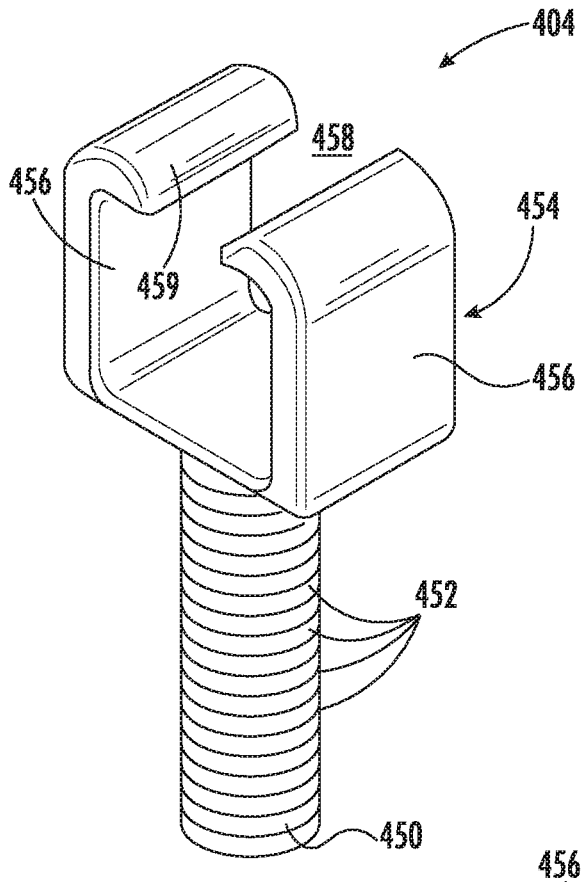
FIG. 16 is a perspective view of the adjustable member of the adjustable RET rod support of FIG. 6.
Figure 17:
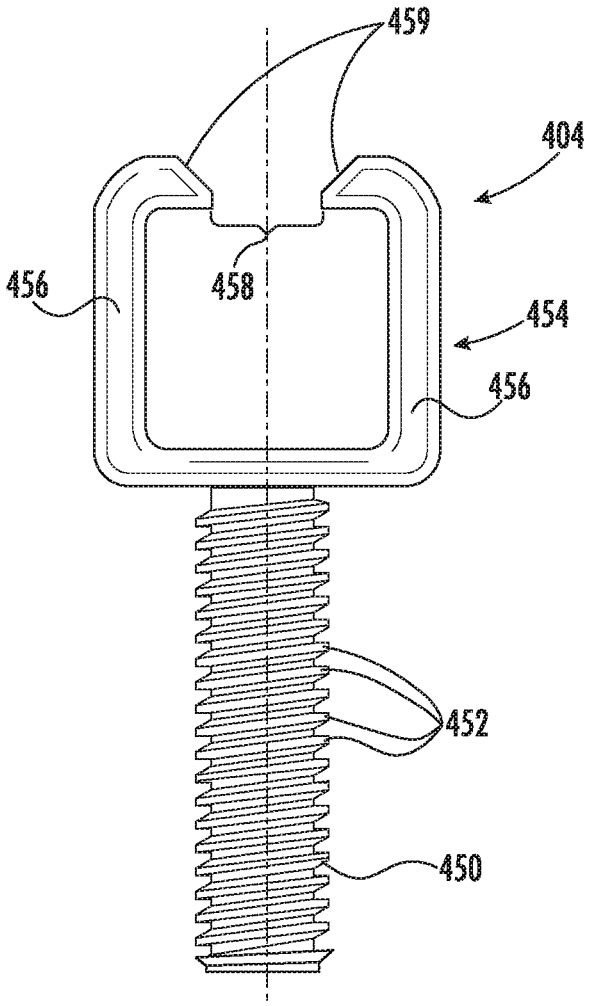
FIG. 17 is a side view of the adjustable member of FIG. 16.
Figure 18:
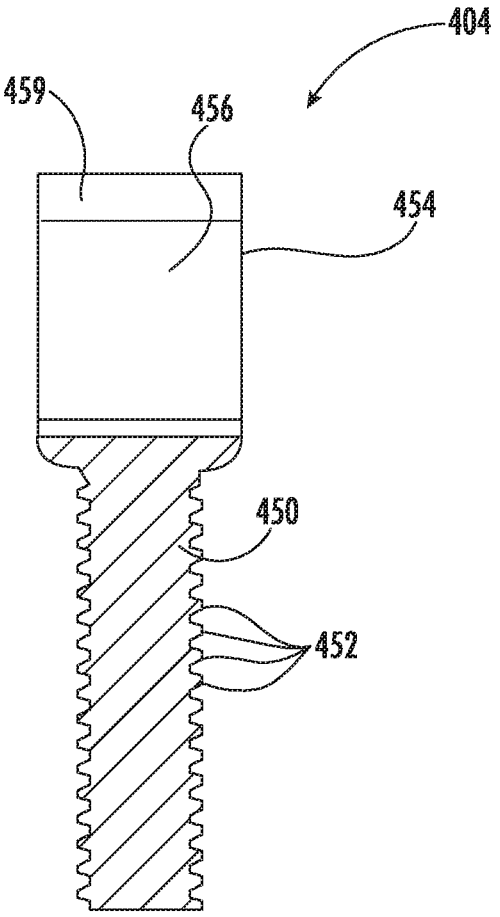
FIG. 18 is a section view of the adjustable member of FIG. 16.

The base member 402 comprises a mounting structure 406 for mounting the base member 402 to the backplane 112. In one embodiment, the mounting structure 406 comprises laterally extending flanges 408 that set against the exposed surface of the backplane 112. A bore 410 is formed in the bottom of the base member 402 between the flanges 408. A pair of transverse slots 411 extend from and communicate with the bore 410. A connector 412 is provided that includes an extending cylinder 414 and a pair of stepped flanges 415 that extend from the cylinder 414. The cylinder 414 has an outer diameter that is the same or slightly larger than the internal diameter of bore 410 and the stepped flanges 415 have a width that is the same or slightly larger than the width of transverse slots 411. The cylinder 414 may be press fit into the bore 410 with the proximal steps of the stepped flanges 415 press fit into slots 411 to secure the connector 412 to the base member 402. FIG. 6 shows the connector 412 partially inserted into the base member 402. When the connector 412 is fully inserted into the base member 402 the backplane 112 is trapped between the connector 412 and the flanges 408.

To mount the RET rod support 400 to the backplane 112 the bore 410 and transverse slots 411 are positioned over a coextensive through-hole 416 formed in the backplane 112. The cylinder 414 and proximal steps of stepped flanges 415 are inserted through the through-hole 416 from the opposite side of the backplane 112 and are press fit into the bore 410 and transverse slots 411, respectively, of the connector 412 trapping the backplane 112 between the flange 408 and the connector 412. The cylinder 414 and proximal steps of stepped flanges 415 may be retained in the base member 402 by the compressive/friction forces created by the press fit connection between these components. Alternatively, the connector 412 may be attached to the base member 402 using an attachment mechanism such as adhesive, separate fasteners, deformable locking members or the like. In other embodiment, the base member 402 may be connected directly to the backplane 112 by fasteners such as screws, deformable tangs that engage apertures on the backplane, adhesive or the like.

The base member 402 further comprises a member 420 that defines an upright that extends from the mounting structure 406 and defines an elongated cavity 422 having a diameter. The base member 402 is configured such that when the base member 402 is mounted to the backplane 112, the cavity 422 extends substantially perpendicular to the back plane 112. In the illustrated embodiment, the cavity 422 comprises a cylindrical bore that extends for substantially the length of the upright 420. In some embodiments, the cavity 422 may communicate with bore 410. While the cavity 422 is shown as cylindrical, it may have other cross-sectional shapes than circular provided that the cavity 422 can slidably receive the adjustable member 404.

The open end of the cavity 422 is provided with a split wall structure where, in the illustrated embodiment, two notches 426 extend from the distal end of upright 420 a distance into the receptacle to create two facing end portions **428*a*, 428*b*. While two notches 426 are shown, a greater or fewer number of notches may be provided. The notches 426 comprise substantially V-shaped notches that narrow from the end of the upright 420, where the side walls of the notches may diverge at approximately 12 degrees. The notches 426 allow the end portions 428*a*, 428*b* of the member 420 to be compressed toward one another to thereby decrease the effective diameter of the cavity 422. In the undeformed or unlocked configuration of the cavity 422, the diameter of the cavity 422 is selected to allow the adjustable member 402 to move linearly in the cavity 422. When the end of the cavity 422 is compressed by squeezing the portions 428***a*, 428*b* toward one another at the notches 426, the effective diameter of the cavity 422 is decreased to lock the adjustable member 404 in position relative to the base portion 402. Compression of the end portions 428*a*, 428*b* decreases the lateral dimension of the cavity. Where the cavity has a circular cross-sectional shape the lateral dimension may be considered the diameter of the cavity, where the cavity has a cross-sectional shape other than circular, the lateral dimension may be other than a diameter; however, the term diameter may be used herein to refer to the lateral dimension between the end portions 428*a*, 428*b* regardless of the cross-sectional shape of the cavity.

Two locking members 429 are provided to hold the upright 402 in the locked positon. The locking members 429 may comprise extending tangs 430 on one of the end portions 428*a*, 428*b* that are received in mating apertures 432 on the other one of the end portions 428*a*, 428*b*. The tangs 430 comprise surfaces 430*a* that engage the edge of the apertures 432 to maintain the locking members in the locked position. One or both of the tangs 430 and apertures 432 may be resiliently deformable to effectuate the locking action. The locking mechanisms 429 may comprise structures other than the locking tangs such as separate fasteners, adhesive, welding, snaps, rivets, staking or the like.

To increase the holding force of the base member 402 on the adjustable member 404 and to facilitate the adjustment of the adjustable member 404 relative to the base member 402, a ratcheting structure 433 is provided between the cavity 422 and the adjustable member 404. In one embodiment, the ratcheting structure 433 comprises a series of ridges 434 formed on the interior surface of cavity 422 that extend generally transversely to the direction of the travel A (see FIG. 8) of the adjustable member 404 in the cavity 422. In one embodiment, the ridges 434 extend around the periphery of cavity 422, except for where the notches 426 are located. In one embodiment the ridges 434 may be formed as a series of teeth, bumps or the like that create alternating raised portions and recessed portions that define stop positons for the adjustable member 404. The adjustable member 404 is formed with mating ridges 452 that interengage with the ridges 434 on the cavity 422 to locate the adjustable member 404 in the cavity 422 and to increase the holding force between the base member 402 and the adjustable member 404. When the ridges 452 on the adjustable member 404 and in the ridges 434 in cavity 422 are engaged and the upright 420 is deformed to the locked position, a mechanical interlock is created between the adjustable member 404 and the base member 402 to fix the position of the adjustable member 404 relative to the base member 402 and to thereby fix the height of the RET rod support 400. When the upright 420 is in the unlocked position, the ridges 452 on the adjustable member 404 and the ridges 434 in cavity 422 may ride over one another such that the adjustable member 404 is movable linearly in the cavity 422, without rotating the adjustable member 404, simply by pushing or pulling the adjustable member 404.

The adjustable member 404 comprises a shaft 450 that is dimensioned to slidably fit within the cavity 422 when the cavity 422 is in the unlocked configuration. The shaft 450 comprises ridges 452 that extend generally transversely to the direction of the travel A (see FIG. 8) of the adjustable member 404 in the cavity 422 and that matingly engage the ridges 434 in cavity 422. In one embodiment, the ridges 452 extend around the periphery of shaft 450. The shaft 450 supports a RET rod holder 454 that is dimensioned to slidably receive a RET rod 166 such that the RET rod 166 can slide in the holder 454 along its longitudinal axis. In the illustrated embodiment, the holder 454 has a generally rectangular shape to retain a square RET rod 166. Where the RET rod has other than a square cross-sectional shape, the holder 454 may be configured to match the shape of the RET rod to closely but slidably retain the RET rod. The holder 454 in the illustrated embodiment, comprises a pair of opposed arms 456, the distal ends of which are spaced from one another to create an opening 458 for receiving the RET rod 166. The ends of arms 456 may be formed with tapered camming surfaces 459 that facilitate the insertion of the RET rod 166 into the holder 454 by easing the spreading of the arms 456 when the RET rod 166 is forced through opening 458.

To use the RET rod support 400, the base member 402 is attached to the backplane 112, as previously described, such that it is aligned with and positioned directly below the RET rod 166 that is to be supported by that RET rod support 400. The adjustable member 404 is pushed linearly into the base member 402 to decrease the height of the RET rod support 400 or pulled linearly out of the base member 402 to increase the height of the RET rod support 400. The ridges 452 on the shaft 450 of the adjustable member 404 ride over the ridges 434 in the cavity 422 in a ratcheting manner as the adjustable member 404 is pushed into or pulled out of the base member 402. The engagement of the ridges 434, 452 temporarily holds the adjustable member 404 in position relative to the base member 402 such that the installer may release the adjustable member 404. This frees the installer's hands to make adjustments to the system and to lock the locking mechanisms 429 without the adjustable member 404 inadvertently moving relative to the base member 402. The height of the RET rod support 400 is adjusted such that the RET rod 166 can freely slide within the rod holder 454 without binding or deformation. The RET rod 166 may be forced into the RET rod holder 454 through opening 458. Once the RET rod holder 400 is adjusted to the proper height, the adjustable member 404 is locked in position relative to the base member 402. Specifically, the two facing end portions 428*a*, 428*b* of the upright 420 are squeezed together to trap the adjustable member 404 in position. The locking members 429 are engaged to maintain the upright 420 in the locked position where the engagement of the ridges 434 with ridges 452 create a mechanical lock between the adjustable member 404 and the base member 402.

In the illustrated embodiment, the female cavity 422 is formed on the base 402 and the male shaft 450 is formed on the adjustable member 404. However, these components may be reversed such that the female receptacle 422 is formed on the adjustable member 404 and the male shaft 450 is formed as the upright on the base member 402. Moreover, in the illustrated embodiment a single adjustable member 404 is mounted on the base member 402. In other embodiments, one or more additional adjustable members may be disposed between the adjustable member 404 and the base member 402 in a telescoping manner where the additional members are movable and lockable relative to one another and to the adjustable member 404 and the base member 402 as previously described.

Figure 19:
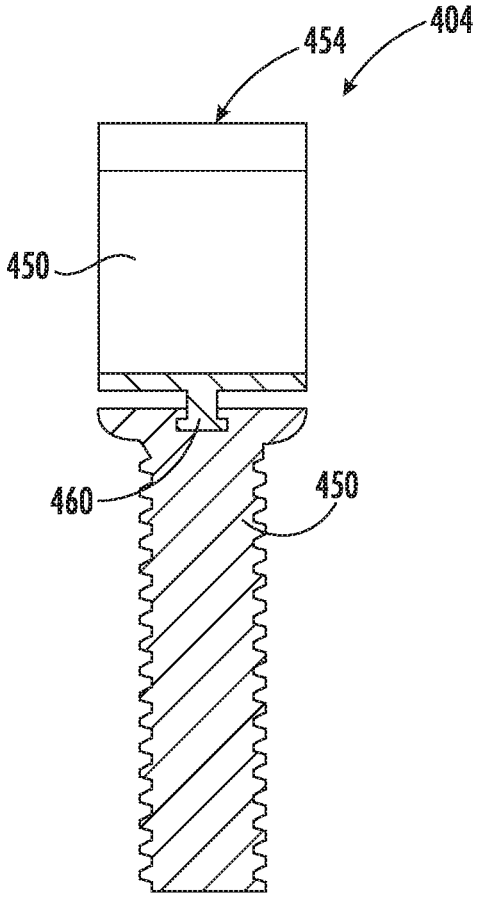
FIG. 19 is a section view of another embodiment of the adjustable member of FIG. 16.

In some embodiments, rather than using the linear movable ratcheting connection between the cavity 422 and the shaft 450, the cavity 422 and the shaft 450 may be formed with mating screwthreads such that movement of the adjustable member 404 relative to the base member 402 is effected by rotating the adjustable member 404 relative to the base member 402 to screw the adjustable member 404 into or out of the base member 402. Because the rotation of the adjustable member 404 may result in the RET rod holder 454 being angularly misaligned with the RET rod 166 when the RET rod support 400 is at the proper height, the holder 454 may be freely pivotably mounted on the shaft 450 by a pin 460 such that the holder 454 may be rotated about the longitudinal axis of the shaft 450 to properly orient the holder 454 relative to the RET rod 166 irrespective of the angular position of the shaft 450, as shown in FIG. 19. In some embodiments, the pitch of the mating threads may be small enough that the holder may be properly oriented relative to the RET rod at the proper height of the RET rod holder and the pivoting holder 454 may be eliminated.

It will be appreciated that screwthreads may also be used as the ridges 434, 452 that form the ratcheting mechanism in the prior embodiment. The difference being that in the ratcheting mechanism, the diameter of the cavity 422 is large enough relative to the diameter of the shaft 450 that the shaft 450 can be simply pushed or pulled linearly with the threads riding over one another. While in the rotating threaded embodiment, the relative diameters of the shaft 450 and cavity 422 require that the adjustable member 404 be rotated to effectuate longitudinal movement between the adjustable member 404 and the base member 402.

Figure 20:
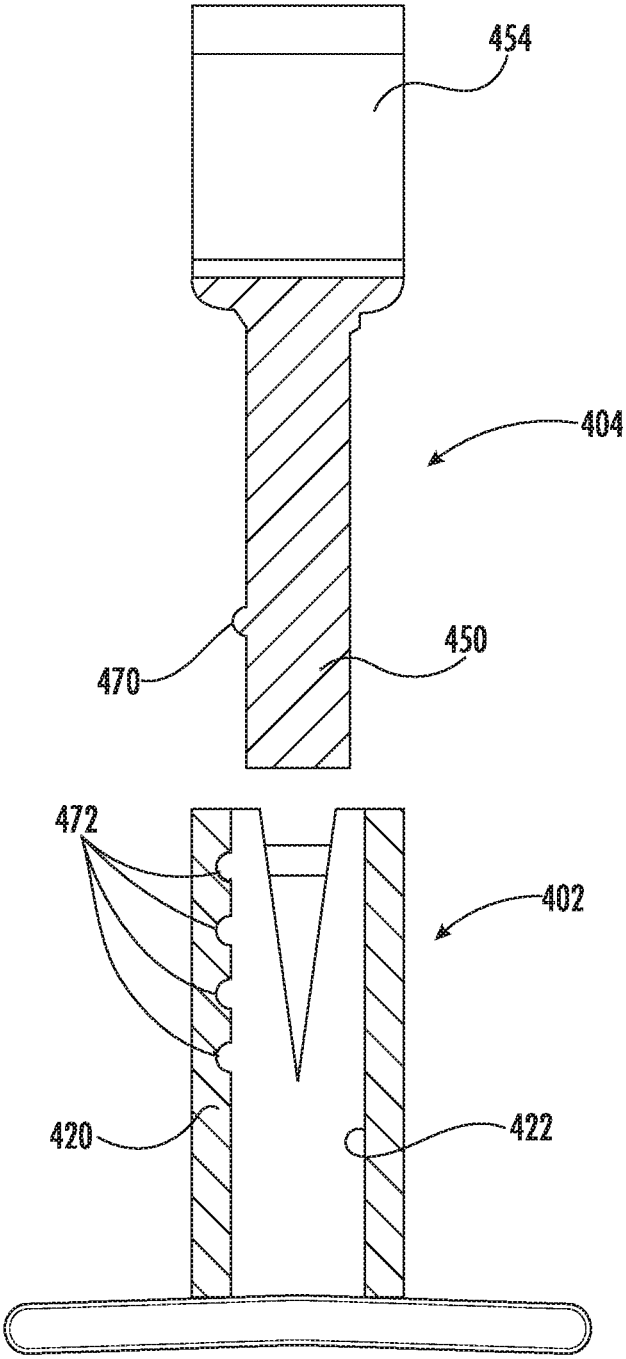
FIG. 20 is a section side view of another embodiment of the adjustable RET rod support of the invention.

In another embodiment, the engagement structures in the cavity 422 and on the shaft 450 may comprise structures other than the raised ridges or threads. For example, the engagement structures may comprise a projection or a series of projections 470 on one of the shaft 450 or the cavity 422 that engage a detent, recess or aperture or a series of detents, recesses or apertures 472 on the other one of the shaft 450 or the cavity 422 as shown in FIG. 20. The size and spacing of the projections and recesses or apertures determines the precision of the adjustment and the number of adjustment positions.

It will also be appreciated that a base station antenna manufacturer may stock a smaller number of parts by using the adjustable RET rod support 400 that can be used with many different adjustable RET linkages/antennas. In some applications a single adjustable RET rod support 400 may be used in all of the manufacturers antenna designs while in other embodiments more than one adjustable RET rod support 400 may be used, each of which is intended to be used with a range of RET antenna designs. In either case, the adjustable RET rod support may be used with many different RET antenna designs and minimize the number of different types of parts that must be stocked.

It will be appreciated that the above embodiments are intended as examples only, and that a wide variety of different embodiments fall within the scope of the present invention. It will also be appreciated that any of the above embodiments may be combined.

Pursuant to further embodiments of the present invention, adjustable RET rod supports are provided that may be formed from one or more standardized parts and one or more of a plurality of changeable parts. For example, a standardized part and one of a plurality of changeable parts may be interconnected to form the adjustable RET rod support 400. For example, a standardized base member 402 may be used with one of a plurality of adjustable members 404 where the adjustable members 404 have different lengths or different size or shaped holders 454.

The present invention has been described above with reference to the accompanying drawings. The invention is not limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Herein, the terms "attached", "connected", "interconnected", "contacting", "mounted" and the like can mean either direct or indirect attachment or contact between elements, unless stated otherwise.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

The invention claimed is:

1. A base station antenna, comprising:

a remote electronic tilt ("RET") actuator;

a phase shifter having a moveable element; and a mechanical linkage extending between the RET actuator and the phase shifter, the mechanical linkage including a RET rod;

an adjustable RET rod support comprising a base member and an adjustable member, the adjustable member comprising a RET rod holder and being movably mounted relative to the base member.

2. The base station antenna according to claim 1, wherein the base member comprises a mounting structure configured to mount the adjustable RET rod support to a backplane.

3. The base station antenna according to claim 2, wherein the mounting structure comprises a connector that engages the base member, the connector being configured to trap the backplane between the connector and the base member.

4. The base station antenna according to claim 3, wherein the connector and the base member include flanges for engaging the backplane.

5. The base station antenna according to claim 3, wherein the connector is press fit into engagement with the base member.

6. The base station antenna according to claim 1, wherein the distance between the RET rod holder and the backplane is variable.

7. The base station antenna according to claim 1, wherein the base member comprises an upright that extends from the mounting structure, wherein one of the upright and the adjustable member defines a cavity having an effective diameter, the cavity receiving the other one of the upright and the adjustable member.

8. The base station antenna according to claim 7, wherein an open end of the cavity comprises a split wall structure.

9. The base station antenna according to claim 8, wherein the split wall structure comprises a plurality of notches that extends from a distal end of the one of the upright and the adjustable member, the plurality of notches creating a plurality of end portions.

10. The base station antenna according to claim 9, wherein the plurality of end portions are compressed toward one another in a locked position to decrease the effective diameter of the cavity and wherein the plurality of end portions in an uncompressed position define an unlocked position.

11. The base station antenna according to claim 10, further comprising a locking member to hold the plurality of end portions in the locked position.

12. The base station antenna according to claim 10, further comprising a ratcheting structure between the base member and the adjustable member.

13. The base station antenna according to claim 12, wherein the ratcheting structure comprises at least one first ridge formed on one of the base member and the adjustable member that engage a plurality of mating second ridges on the other one of the adjustable member and the base member to create a mechanical interlock.

14. The base station antenna according to claim 12, wherein the ratcheting structure comprises at least one projection on one of the base member and the adjustable member that engages at least one detent, recess or aperture on the other one of the adjustable member and the base member to create a mechanical interlock.

15. The base station antenna according to claim 1, wherein the adjustable member comprises a plurality of telescoping sections.

16. The base station antenna according to claim 1, wherein the adjustable member is threadably connected to the base member.

17. The base station antenna according to claim 16, wherein the RET rod holder is pivotably connected to the adjustable member.

18. The base station antenna according to claim 1, wherein the RET rod has a longitudinal axis and the RET rod holder is configured to slidably receive the RET rod such that the RET rod is slidable in the RET rod holder along the longitudinal axis.

19. A method of mounting a RET rod in a base station antenna, comprising:

mounting an adjustable RET rod support on a backplane of the base station antenna wherein the adjustable RET rod support comprises a base member and an adjustable member, the adjustable member comprising a RET rod holder and being movably mounted relative to the base member;

moving the adjustable member relative to the base member to position the RET rod holder relative to the backplane; and inserting a RET rod into the RET rod holder.

20. The method of claim 19 wherein the step of moving the adjustable member relative to the base member, comprises one of threadably rotating the adjustable member relative to the base member and linearly ratcheting the adjustable member relative to the base member.

* * * * *